United States Patent [19]

Chen

[11] Patent Number: 4,597,315

[45] Date of Patent: Jul. 1, 1986

[54] PIPE WRENCH

[76] Inventor: Chao-Yang Chen, No. 585, San-Feng Rd., Feng-Yuan City, Taiwan

[21] Appl. No.: 805,205

[22] Filed: Dec. 4, 1985

Related U.S. Application Data

[63] Continuation-in-part of Ser. No. 667,538, Nov. 2, 1984, Pat. No. 4,561,330.

[51] Int. Cl.[4] ..... B25B 13/22

[52] U.S. Cl. ..... 81/129.5; 81/133

[58] Field of Search ..... 81/126, 128, 129, 129.5, 81/141, 142, 143, 145, 146, 147, 150, 151, 152

[56] References Cited

U.S. PATENT DOCUMENTS 1,023,001 4/1912 Bennetch ..... 81/133

1,094,221 4/1914 Kuhns ..... 81/133

4,452,108 6/1984 Irwin et al. ..... 81/129

*Primary Examiner*—James L. Jones, Jr.

*Attorney, Agent, or Firm*—Abelman Frayne Rezac & Schwab

[57] ABSTRACT

A pipe wrench which comprises a body carrying a fixed jaw and pivoted to a handle and a L-shaped member having a rack portion movably inserted in the body and a movable jaw extending out of the body, wherein a pinion is disposed in the body to engage with the rack portion and a detent member which restricts the pinion to turn in a single direction. The detent member is of such a construction that also allow the rack portion to move outward and inward swiftly.

5 Claims, 7 Drawing Figures

PIPE WRENCH

This invention is a continuation-in-part application of U.S. application Ser. No. 667,538 filed on Nov. 2, 1984, now U.S. Pat. No. 4,561,330.

BACKGROUND OF THE INVENTION

This invention relates to a pipe wrench, particularly to an improved pipe wrench with quick-action opening and closing of its jaws.

U.S. Pat. No. 4,561,330 discloses a pipe wrench which includes a handle pivoted to a body carrying a fixed jaw, and a movable jaw integrating a rack bar which is movably inserted in the body. A toothed pivot member is provided in the body to engage with the rack bar and a ratchet mechanism is provided to restrict the toothed pivot member so that it moves in a single direction when the handle is levered. The direction of the rotary movement of the toothed pivot member can be changed by a controlling member, so that the movable jaw can be moved either to or away from the fixed jaw by operating the handle. In such a device, the movable jaw can not be moved as quickly as desired, since its movement can be imparted only upon operating the handle.

SUMMARY OF THE INVENTION

It is an object of the invention to provide an improvement over a pipe wrench of the above type in which the movable jaw can be moved to or away from the fixed jaw by being pushed inward or outward by one's hand.

It is another object of the invention to provide a pipe wrench of the above type with a simplified construction.

The invention provides an improved toothed pivot member to engage with a rack bar and an improved detent member to engage with the toothed pivot member. Normally, the toothed pivot member is prevented from moving in a first direction by the detent member. However, the detent member can be retracted in a specific situation to allow the toothed pivot member to make a swift rotation in a direction opposite the first direction simultaneously with the swifh outward movement of the rack bar. The toothed pivot member has radial teeth extending axially on its periphery and engaging with the rack bar and the detent member. The detent member is received in a bore and biassed by a spring. The axis of the bore is inclined relative to a diameter of a pivot circular opening receiving the toothed pivot member, the diameter intersecting said axis where the pivot opening and the bore meet. The detent member has an engaging flat face perpendicular to the axis of said bore.

The present exemplary preferred embodiment will be described in detail with reference to the following drawings, in which:

DETAILED DESCRIPTION OF THE PREFERRED EMBODIMENT

Figure 1:
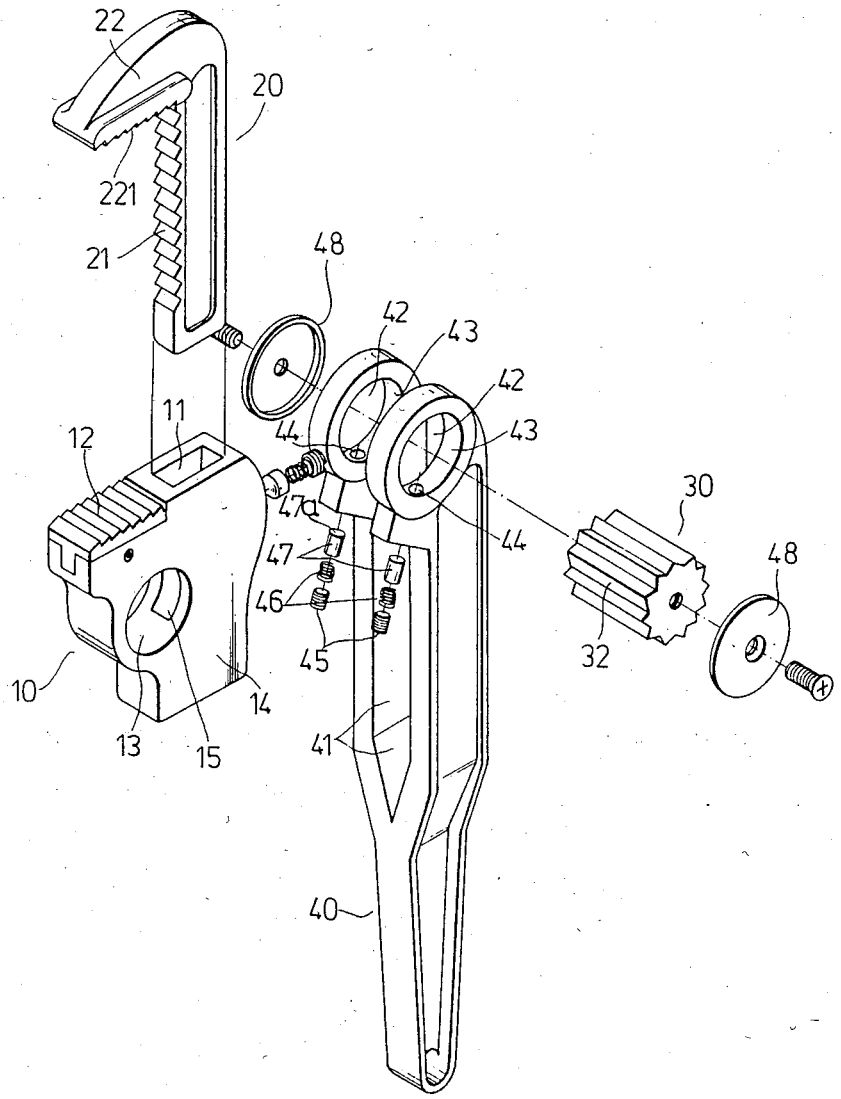
FIG. 1 is an exploded view of a pipe wrench according to the invention.
Figure 2:
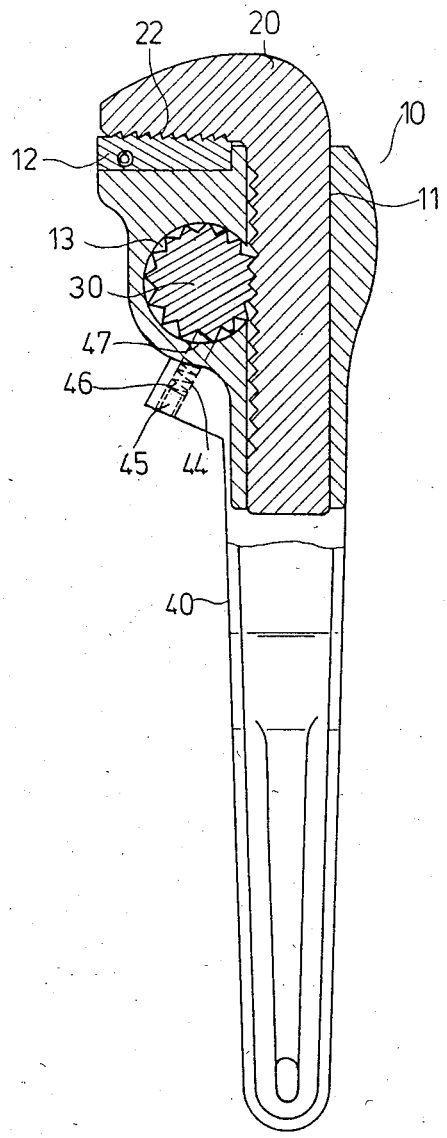
FIG. 2 is an elevation view of a pipe wrench of FIG. 1.

Referring to FIGS. 1 and 2, a pipe wrench according to the invention includes a handle 40 which has two parallel arms 41 extending from one of its ends. Each of the arms 41 is provided with a circular opening 42 coaxial with that of the other arm 41. A body 10 is provided between the arms 41 of the handle 40 for being pivoted about the axis of the opening 42. The body 10 includes two parallel sides 14, a circular through-hole 13 opening at parallel sides 14, which is put in a coaxial relationship with the openings 42, a front end face provided with a fixed jaw 12, an elongate guide bore 11 opening at the front end face of the body 10 and extending into the body 10 in a perpendicular direction to the front end face. The through-hole 13 is communicated with the guide bore 11 through an opening 15.

A cylindrical pivot member 30 which has radial teeth 32 extending axially from its periphery is provided in the through-hole 13 of the body 10, the ends of the pivot member 30 extending into the openings 42 of the handle 40. Each of the teeth 32 is of triangular cross-section of triangular shape. Two circular plates 48 are screwed to the end faces of the pivot member 30 and abut against the arms 41.

Figure 3:
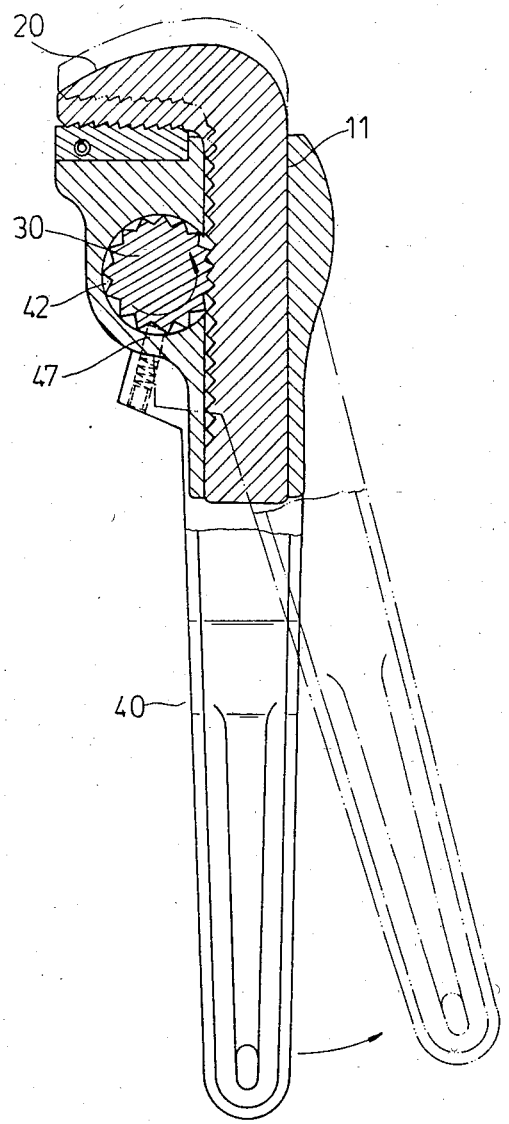
FIGS. 3, 4 and 5 show the operation of the pipe wrench.

There is a bore 44 provided in each arm 41, of which one end opens at the inner periphery 43 defining the circular opening 42 and of which another end is blocked by a cylindrical block 45. The bore is thus communicated with the opening 42, and the axis of the bore 44 is inclined relative to a diameter of the opening 42 intersecting said axis at the periphery 43. In each bore 44 is provided a detent member 47 biassed by a helical spring 46 to engage with the toothed pivot member 30. The detent member 47 is a cylindrical piece having a flat end face **47*a* perpendicular to the axis of the bore 44. The flat end face 47*a* of the detent member 47 is in contact with an inclined face of a tooth 32 of the pivot member 30 by the biassing action of the spring 46. When the handle 40 is turned upward, as shown in FIG. 3, or the pivot member 30 is turned clock-wise, teeth 32 will depress the detent member 47 to retract in the bore 44**.

There is a L-shaped member 20 which has a rack portion 21 inserted movably in the guide bore 11 of the body 10 and put into mesh with teeth 2 of the toothed pivot member 30. A movable jaw portion 22 of the L-shaped member extends out of the guide bore 11 and is provided with a toothed face 221 opposing the fixed jaw 12.

Figure 4:
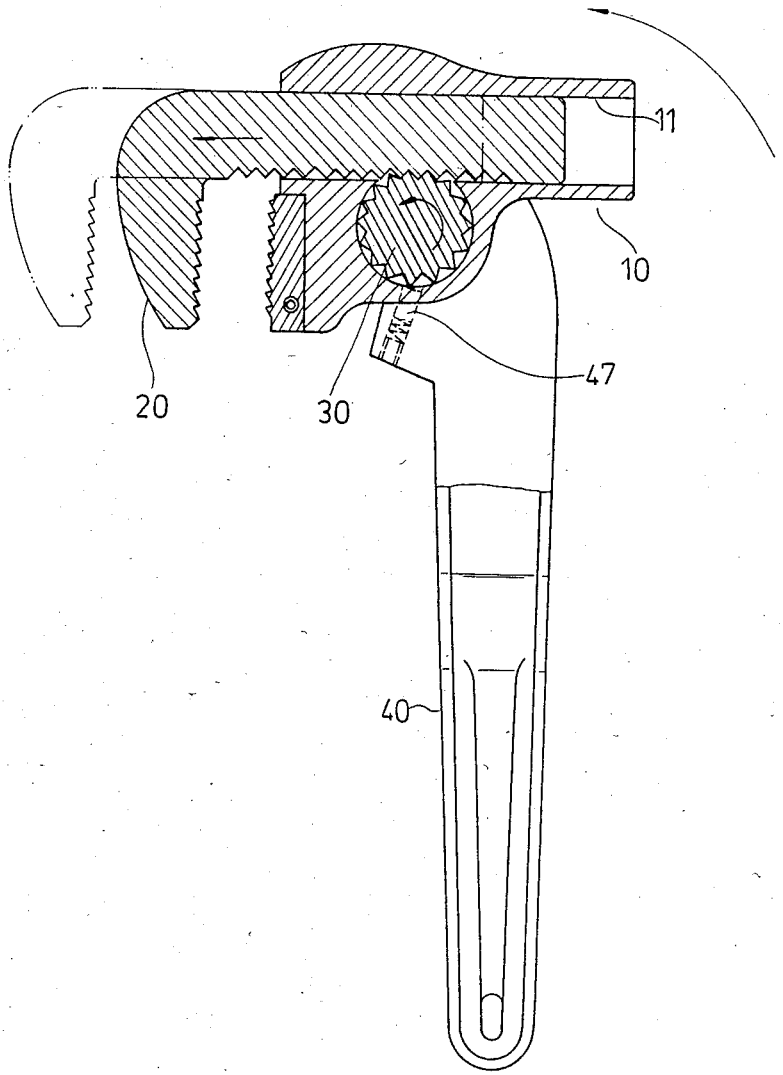

In order to open the jaws, i.e. to move the movable jaw 22 away from the fixed jaw 12, one can hold the handle 40 and wave it swiftly upward so that the body 10 will turn at a certain angle or at a right angle relative to the handle 40, as shown in FIG. 4. During this movement, the detent member 47 will reach a position in which it is retracted completely into the bore 44 by the extremity of a tooth 32, as shown in FIG. 4, and, concurrently, the rack portion 21 moves swiftly outward from the guide bore 11 of the body 10 simultaneously with the swift counter-clockwise rotation of the pivot member 30. After the jaws are opened, the movable jaw 22 can be moved again toward the fixed jaw 12 by being pushed inward with one's hand.

Figure 5:
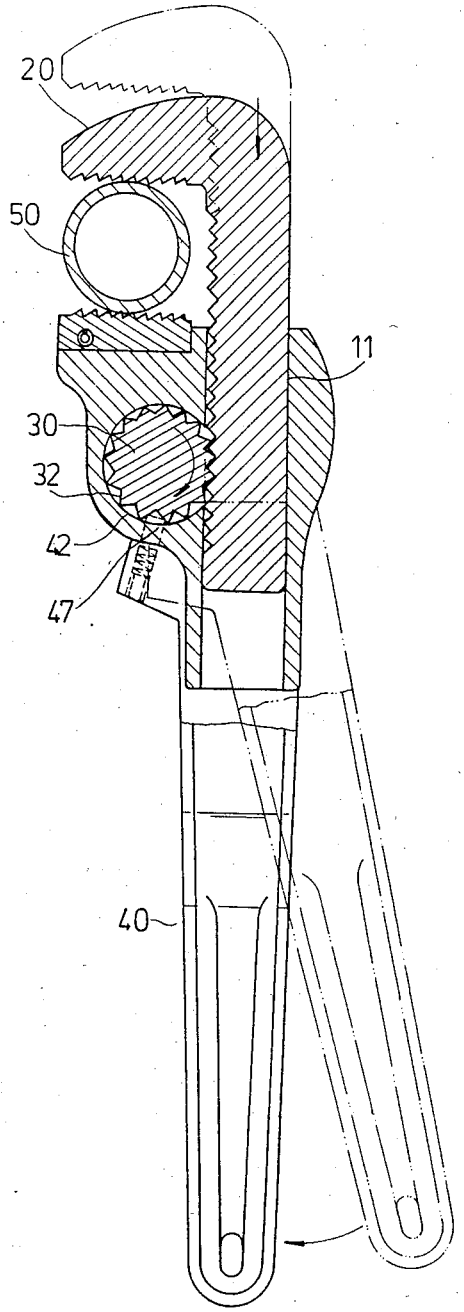

When an object 50 is placed between the movable jaw 22 and the fixed jaw 12, the object can be clamped tightly by turning the handle 40 upward and downward. When the handle 40 is turned upward, the detent member 47 goes into the retracted position so that the pivot member 30 does not moved. When the handle 40 is turned downward, as shown in FIG. 5, the detent member 47 engages with the teeth 32 and turns the pivot member 30 clockwise. The clockwise movement of the pivot member 30 causes the rack portion 21 to move inward so that the object can be clamping tightly between the movable jaw and the fixed jaw.

Although the detent member 47 is depressed by teeth 32 when the handle 40 is turned upward, it can still move the pivot member 30 slightly counterclockwise before it retracts fully into the bore 44. Therefore, to release the object from the tight clamp, one can turn the handle 40 upward to move the movable jaw 22 slightly away from the object.

Figure 6:
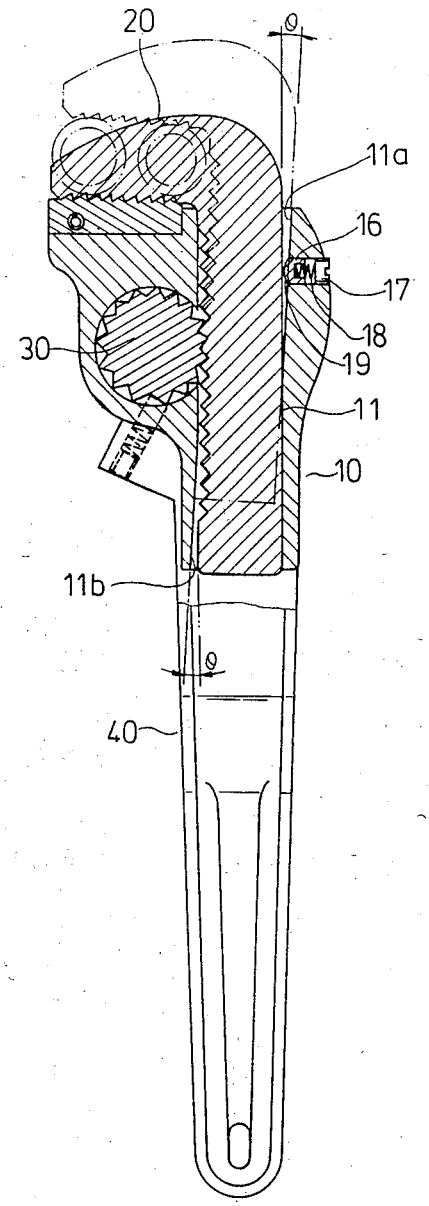
FIG. 6 is an elevation view of the pipe wrench in another embodiment.

FIG. 6 shows another preferred embodiment of the pipe wrench which is of generally the same construction as the pipe wrench described above, except that a push member 19 biassed by a spring 18 is provided in a hole 16. A screw member 17 is threadedly inserted in the hole 16 to hold the spring 18 and the push member 19 in the hole 16 provided in the body 10. In the figure, numerals similar to the numerals used in the drawings of the former embodiment represent the same elements. The axis of the hole 16 is perpendicular to the axis of the guide bore 11 and provided near the open end of the bore 11. The inner surface defining the bore 11 has a portion 11*a* and another portion 11*b* slightly slanted relative to the axis of the bore 11, and preferably the inclining angles O are about 3 degrees. The inclination of the portions 11*a* and 11*b* are in the opposite directions. The push member 19 pushes one side of the rack portion so that the toothed face 221 of the movable jaw 22 will incline inward slightly relative to the toothed face of the fixed jaw 12. The movable jaw 22 in this arrangement clamps an object against the fixed jaw 12 in a position shown in FIG. 6, in which the object is at the deeper portion of the opening defined by the fixed jaw and the movable jaw.

Figure 7:
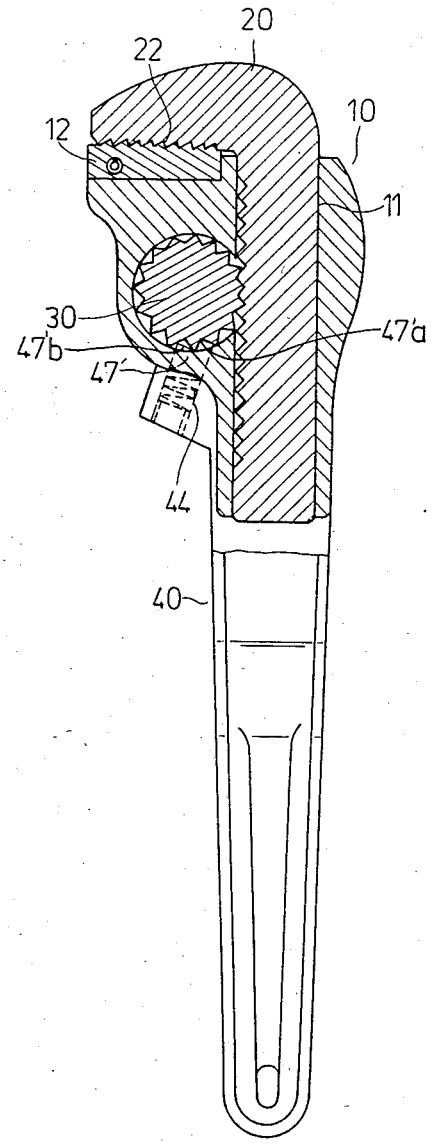
FIG. 7 is an elevation view of the pipe wrench in still another embodiment.

FIG. 7 shows a pipe wrench in still another embodiment which differs from that of the first embodiment in that detent member 47' includes a stepped engaging face having a lower face 47'*b* and an upper face 47'*a* both of which are perpendicular to the axis of the bore 44.

With the invention thus explained, it is apparent that various modifications and variations can be made without departing from the scope of the invention. It is therefore intended that the invention be limited as indicated in the appended claims.

What I claim is:

1. A improved pipe wrench comprising:

a handle having two parallel arms extending from one of its ends, each of said arms having an opening aligned with that of the other one of said arms;

a body placed between said arms for being pivoted to said handle, which has a through-hole in alignment with said openings, and a fixed jaw incorporated therein, said fixed jaw having a first toothed face;

a cylindrical toothed pivot member inserted in said through-hole and said openings;

a detent member mounted in each of said arms and biassed to engage with said toothed pivot member;

a L-shaped member having a rack portion movably inserted in said body and engaging with said toothed pivot member, and a movable jaw extending out of said body, said movable jaw having a second toothed face;

wherein each of said arms further includes a bore communicated with said opening, the axis of said bore being inclined relative to a diameter of said opening intersecting said axis at one end of said diameter, said detent member being provided in said bore axially and having an engaging face perpendicular to said axis of said bore, and said toothed pivot member including radial teeth extending axially on its periphery, said teeth being capable of engaging said rack portion to move said rack portion inwardly and outwardly, causing said engaging face of said detent member to retract in said bore when said pivot member is moved in a first direction and engaging with said detent member when said pivot member is moved in a second direction opposite to said first direction.

2. An improved pipe wrench as claimed in claim 1, wherein each of said radial teeth of said pivot member is of triangular cross-section.

3. An improved pipe wrench as claimed in claim 1, wherein said detent member includes a cylindrical piece having a flat end face biassed to extend out of said bore.

4. An improved pipe wrench as claimed in claim 1, further comprising a spring biassed means provided in said body adjacent to said rack portion for normally pushing said rack portion so that said second toothed face inclines slightly toward said first toothed face.

5. An improved pipe wrench as claimed in claim 1, wherein said engaging face of said detent member is stepped having a lower flat face and an upper flat face which are perpendicular to the axis of said bore.

* * * * *